US005680823A

United States Patent [19]

LaRose

[11] Patent Number: 5,680,823

[45] Date of Patent: Oct. 28, 1997

[54] SHORT FLAME XCL BURNER

[75] Inventor: Jeffrey A. LaRose, Stowe, Ohio

[73] Assignee: The Babcock & Wilcox Company, New Orleans, La.

[21] Appl. No.: 408,671

[22] Filed: Mar. 22, 1995

[51] Int. Cl.[6] ..... F23C 1/10

[52] U.S. Cl. ..... 110/262; 110/104 B; 110/264; 110/265; 110/347; 431/185; 431/187

[58] Field of Search ..... 110/261, 262, 110/264, 265; 431/182, 183, 185, 187; 239/501, 502

[56] References Cited

U.S. PATENT DOCUMENTS

| | | | |
|---|---|---|---|
| 4,702,180 | 10/1987 | Kiga | 110/264 X |
| 4,930,430 | 6/1990 | Allen et al. | 110/264 |
| 5,113,771 | 5/1992 | Rini et al. | 110/264 X |
| 5,388,536 | 2/1995 | Chung | 110/264 |
| 5,529,000 | 6/1996 | Hartel et al. | 431/183 X |

FOREIGN PATENT DOCUMENTS

| | | | |
|---|---|---|---|
| 2070761 | 9/1981 | United Kingdom | 110/261 |

*Primary Examiner*—Henry A. Bennett
*Assistant Examiner*—Susanne C. Tinker
*Attorney, Agent, or Firm*—Daniel S. Kalka; Robert J. Edwards

[57] ABSTRACT

A pulverized fuel burner having lower emissions and lower unburned fuel losses by outwardly diverting and swirling pulverized fuel at the outlet of a fuel nozzle carrying the pulverized fuel. Diverting cone is positioned at the outlet of the fuel nozzle and include swirling plates connected there between for outwardly diverting some of the pulverized fuel and swirling a remainder of the pulverized fuel. Together these effects reduce the axial momentum of the fuel, shortening the flame and improving its emission and unburned fuel loss characteristics.

7 Claims, 2 Drawing Sheets

SHORT FLAME XCL BURNER

BACKGROUND OF THE INVENTION

1. Field of the Invention

The present invention relates in general to fuel burners, and in particular to an improved pulverized fuel burner which produces a short flame.

2. Description of the Related Art

The Babcock & Wilcox (B&W) XCL coal burner is shown in FIG. 1. This burner is commonly used for reduced emissions with low unburn carbon losses. This performance is achieved by delaying $NO_x$ producing combustion through the use of internal staging. This results in longer, tube-shaped flames. Such longer flame lengths have caused some concerns among potential customers with single wall fired furnaces.

As shown in FIG. 1, the burner includes a conical diffuser 10 within the central conduit of the burner which is supplied with pulverized coal and air by way of a coal inlet 12. A windbox 14 defined between inner and outer walls 16, 18 contains the burner conduit which is concentrically surrounded by walls which contain an outer array of fixed spin vanes 20 and adjustable vanes 22. An air separator plate 24, concentrically around the burner nozzle, helps channel inner secondary air at 26, and outer secondary air at 28. This creates a high-temperature fuel rich devolatilization zone A, followed by an area B where reducing species are produced, which in turn is followed by $NO_x$ decomposition zone C, and finally a char oxidizing zone D.

U.S. Pat. No. 4,380,202 to LaRue et al. is also relevant to a burner having a conical diffuser and some of the other elements of FIG. 1.

Impellers are routinely installed on coal nozzles to reduce flame length at the expense of emissions. Impellers and similar devices, such as swirlers, only change the fuel stream flow patterns. These approaches can cause either faster oxygen mixing which increases $NO_x$ emissions or fuel concentrations which increases unburn carbon losses, or both.

U.S. Pat. No. 4,479,442 to Itse et al. discloses a venturi nozzle for pulverized coal including a divergent flow separator and multiple swirl vanes.

A device to achieve low emissions and low unburn carbon losses must redirect the axial momentum of the coal nozzle while not increasing the oxygen mixing nor concentrating the fuel stream.

SUMMARY OF THE INVENTION

An object of the present invention is to provide a device which can achieve low emissions and low unburn carbon losses, by redirecting the axial momentum of the coal nozzle in the burner, without increasing oxygen mixing and without concentrating the fuel stream.

A further object of the present invention is to provide a pulverized fuel burner with low emissions and low unburned fuel losses, comprising; means defining a fuel nozzle for passage of pulverized fuel, the fuel nozzle having an outlet end with an axis and an inwardly facing outer surface extending around the axis; and means between the axis and the outer surface of the outer end of the nozzle, for reducing an axial momentum of fuel flowing through the outlet end.

Still a further object of the invention is to provide a pulverized fuel burner which reduces the axial momentum of the fuel flowing out of the nozzle outlet by directing some of the fuel radially outwardly and swirling a remaining flow of fuel.

The invention is further achieved in a burner having inner and outer air registers concentrically around the nozzle, with a flow turn assister in the inner register and one or more directional vanes extending inwardly from the outer surface of the nozzle.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
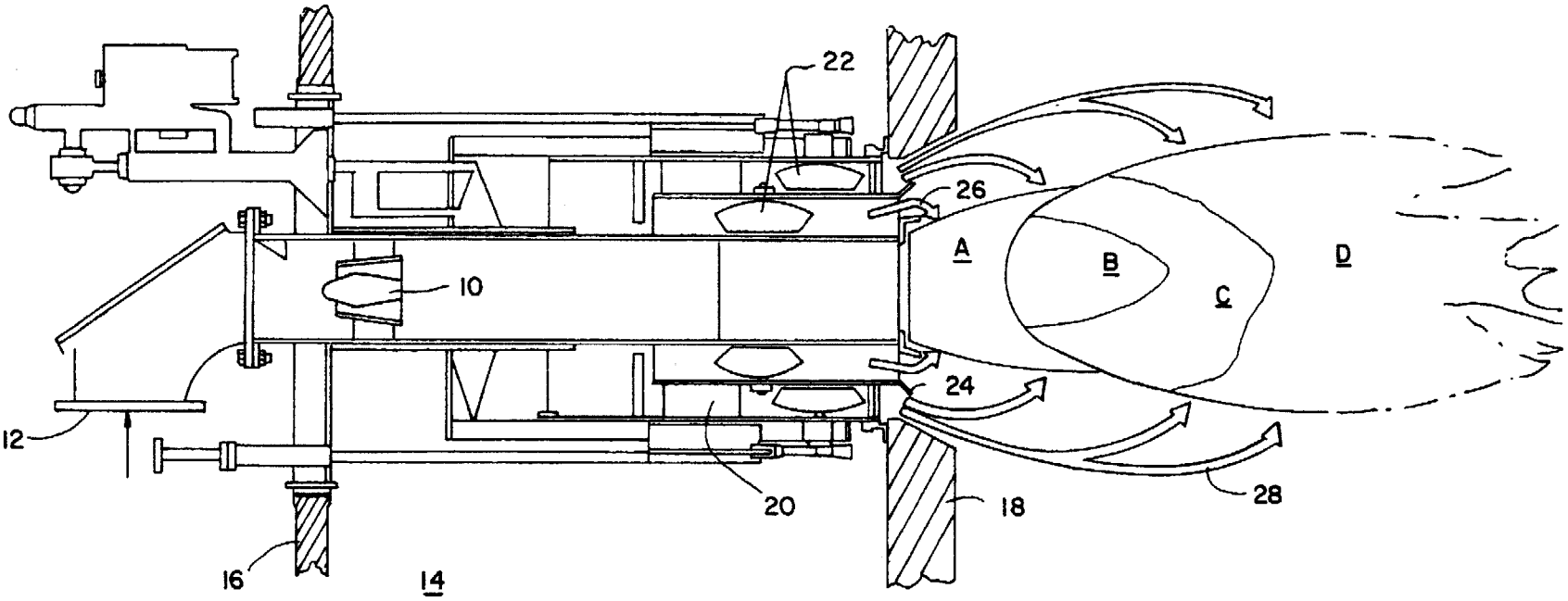
FIG. 1 PRIOR ART
FIG. 1 is a schematic sectional view of a known XCL burner which is improved using the present invention.

Referring to the drawings in particular, the invention comprises a modified XCL burner which reduces emissions and which also reduces unburned fuel losses.

Figure 2:
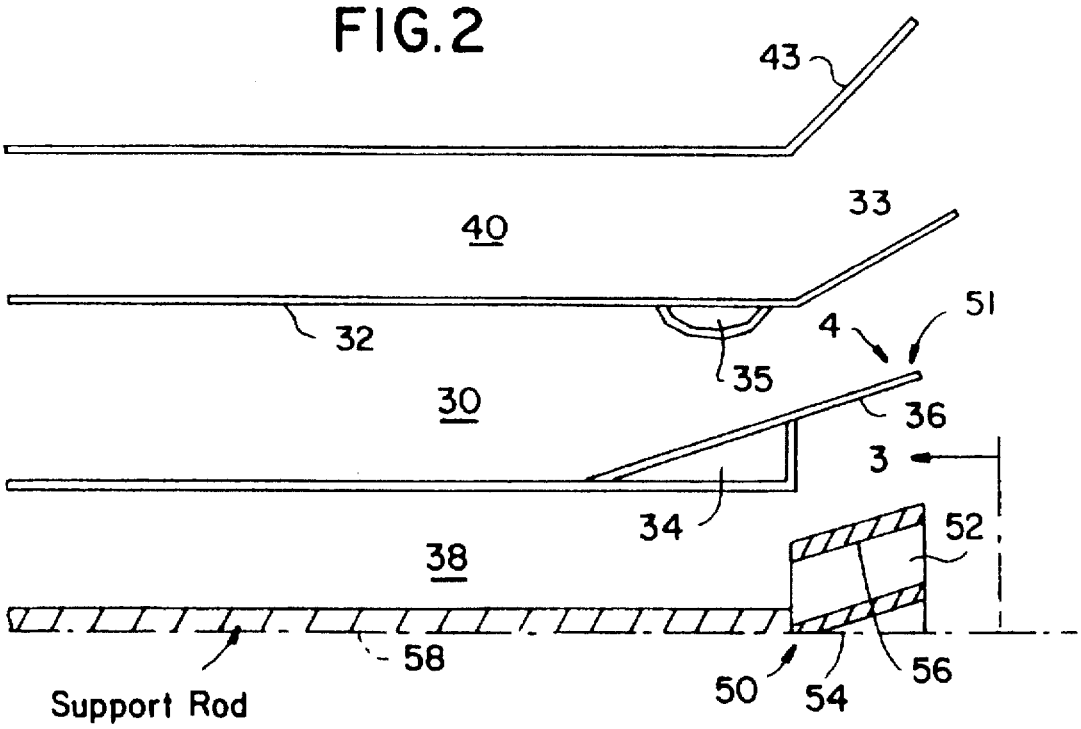
FIG. 2 is a schematic sectional view showing one half of a modified burner according to the present invention.
Figure 3:
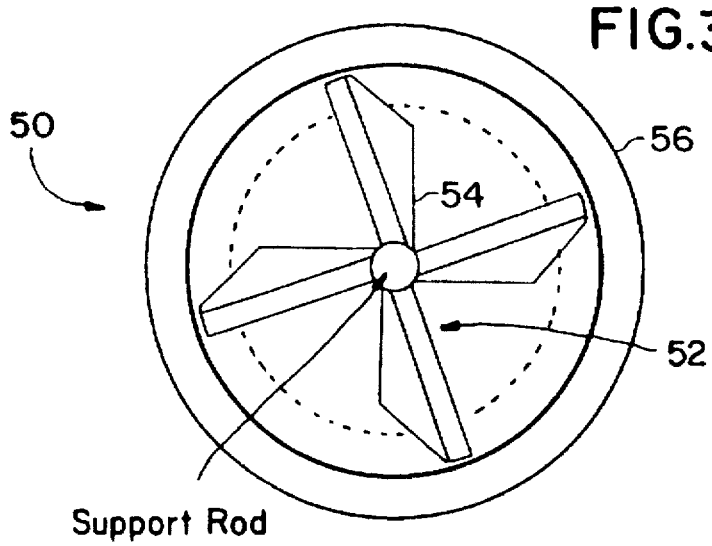
FIG. 3 is an axial view taken in the direction of arrow 3, near the outlet of a coal nozzle for the invention.

Modifications have been developed according to the invention to reduce the flame length while not sacrificing the performance of the original B & W XCL burner. These modifications involve changes to the exit of the inner, secondary air register and changes to the end of the coal nozzle. The new Short Flame XCL ("SF-XCL") TM Burner is shown in FIGS. 2 and 3.

The inner, secondary air register 30 is modified to more efficiently move the air radially outwardly. A single directional vane 34 on the outside conical surface 36 of the coal nozzle 38 is added along with a flow turn assistor 35. The directional vane 34 changes the direction of the axial momentum and will help delay oxygen and fuel mixing. The flow turn assistor 35 is a simple device (i.e., easy to make and install) to improve the efficiency of the turn without an elaborate venturi or vane design. A small air recirculation zone will occur adjacent the downstream side to the device. This will improve the air's ability to reattach to the air separation plate 32 between the inner and outer registers 30, 40. Plate 32 has a conical outlet end 33, as does outer register outlet 43.

A dual purpose device 50 is added to outlet end of the coal nozzle 38 instead of an emissions increasing impeller. This device reduces the coal nozzle axial momentum by directing some of the fuel rich flow radially outwardly and swirling the remaining flow. The radial flow is directed at an angle less than or equal to the angle of the inner register directional vane 34, by diverting cone 56. Note: Item 54 is one of the internal swirler vanes shown in FIG. 3 of item 50. This preserves the low $NO_x$ qualities of the original burner. The inner swirler 52 evenly distributes the remaining fuel rich flow into the cone formed by the radially directed fuel flow. Inner swirler 52 comprises four plates extending between the support rod 58 and diverting cone 56; and at an angle to the axis 58 of the burner. This more evenly distributed fuel rich zone will reduce the unburn carbon losses.

Figure 4:
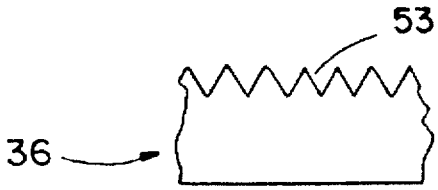
FIG. 4 is a schematic generated view taken in the direction of arrow 4 in FIG. 2.

As shown in FIG. 4, optionally, teeth 53 can be added to the outlet edge of the outside conical surface 36 for stabilizing the burner flame if needed. The outlet cones 36, 33 and 43 diverge conically outwardly from the axis 58 of the burner, and the outlet direction of the burner, at various acute angles to the axis.

This unique arrangement has the advantage over the current design of shorter flame lengths while retaining the positive attributes of low emissions and unburn carbon losses. This is achieved by redirecting both the inner register secondary air and a portion of the fuel stream radially outward and redistributing the remaining fuel stream to fill the resulting inner cone. The oxygen mixing rate characteristics are presevered from the original nonimpeller design while good fuel distribution will reduce the unburn carbon losses.

While a specific embodiment of the invention has been shown and described in detail to illustrate the application of the principles of the invention, it will be understood that the invention may be embodied otherwise without departing from such principles.

I claim:

1. A pulverized fuel burner with low emissions and low unburned fuel losses, comprising:

means defining a fuel nozzle for passage of pulverized fuel, the fuel nozzle having an outlet end with an axis and an inwardly facing outer surface extending around the axis;

means between the axis and the outer surface of the outer end of the nozzle for reducing an axial momentum of fuel flowing through the outlet end, said means for reducing axial momentum including means for radial diverting at least some of the fuel flow outwardly away from the axis, and means for swirling a remainder of the fuel flow around the axis; and means around the fuel nozzle for defining inner and outer air registers, said means defining the inner and outer air registers including a separation plate between the inner and outer registers, said separation plate having an outlet end, and at least one flow turn assistor on an inner surface of the separation plate near the outlet, and a directional vane between the fuel nozzle and the inner air register.

2. A burner according to claim 1 wherein the means for reducing axial momentum includes at least one internal swirler vane on the outer surface of the fuel nozzle extending into the fuel nozzle.

3. A burner according to claim 1 wherein means for reducing said axial momentum include support means in the fuel nozzle and an axial momentum reducer connected to the support means, extending around the axis and being in the outlet of the nozzle.

4. A burner according to claim 2 wherein said axial momentum reducer comprises an outer diverting cone.

5. A burner according to claim 4 wherein said means for reducing axial momentum further includes a plurality of internal swirler vanes extending between the diverting cone and support rod at an angle to the axis for swirling fuel flowing between the cones.

6. A burner according to claim 1 wherein said means for defining an inner air register includes a conical section having an outer edge with teeth for shaping a flame formed by the burner.

7. A burner according to claim 5 wherein said plurality of internal swirler vanes comprises four internal swirler vanes.

* * * * *